US009950909B1

(12) United States Patent
Kazemirad

(10) Patent No.: US 9,950,909 B1
(45) Date of Patent: Apr. 24, 2018

(54) TUNNEL RELIEF DEVICE

(71) Applicant: Mohammad Kazemirad, Tehran (IR)

(72) Inventor: Mohammad Kazemirad, Tehran (IR)

( * ) Notice: Subject to any disclaimer, the term of this patent is extended or adjusted under 35 U.S.C. 154(b) by 0 days.

(21) Appl. No.: 15/430,528

(22) Filed: Feb. 12, 2017

(51) Int. Cl.
*A62C 3/02* (2006.01)
*A62C 35/68* (2006.01)
*B66C 19/00* (2006.01)

(52) U.S. Cl.
CPC ..... *B66C 19/005* (2013.01); *A62C 3/0221* (2013.01); *A62C 35/68* (2013.01)

(58) Field of Classification Search
CPC ..... A62C 3/0221; A62C 35/68; B66C 17/00; B66C 17/04; B66C 17/06; B66C 19/005; E21F 11/00; E21F 13/00; E21F 17/18
See application file for complete search history.

(56) References Cited

U.S. PATENT DOCUMENTS 6,834,728 B2 * 12/2004 Demole ..... A62C 3/0292 169/5
2007/0210192 A1 * 9/2007 Piatti ..... A62C 3/0221 239/750

FOREIGN PATENT DOCUMENTS

CN 201310036164 5/2013
DE 10051285 A1 * 5/2002 ..... A62C 3/0221
WO WO 0061236 A1 * 10/2000 ..... A62C 3/0221
WO WO 2007118499 A1 * 10/2007 ..... A62C 3/0221

* cited by examiner

*Primary Examiner* — Darren W Gorman

(57) ABSTRACT

A tunnel relief device includes an arcuate frame member, at least two fire-extinguishing arms, and a transport assembly. The arcuate frame member traverses along a length of the tunnel via first guide rails positioned on an inner surface of the tunnel. The fire-extinguishing arms are positioned on an inner surface of the arcuate frame member and traverse along the inner surface of the arcuate frame member via second guide rails to extinguish fire induced in the tunnel. The transport assembly comprises extendable arms and housed in an upper region of the arcuate frame member. The extendable arms are movable in a horizontal or vertical direction. The transport assembly is rotatably engaged to the upper region of the arcuate frame member to transport the vehicles in the tunnel from a first position to a second position to ensure safe and unobstructed movement of the vehicles in the tunnel.

18 Claims, 6 Drawing Sheets

TUNNEL RELIEF DEVICE

BACKGROUND OF THE INVENTION

Tunnels are structures generally created in rock formations that have an entrance and an exit to provide a passageway for vehicular or foot traffic. Additionally, tunnels are created from underground passageways to facilitate traffic flow. Typically, tunnels are constructed to provide improved connectivity between major cities or prevent traffic bottlenecks within a city. Consequently, many of these tunnels are prone to traffic blocks during peak hours.

In the event of an accident or breakout of fire in a tunnel, relief workers or vehicles find affected areas of the tunnel highly inaccessible due to the obstruction of traffic. Moreover, even if any vehicle suffers a break down, it will result in accumulation of traffic in the tunnel. In such cases, relief work in the tunnels is hindered and towing vehicles are rendered ineffective. A device, which allows instant access to an affected area of a tunnel to prevent obstruction of traffic, is required. Moreover, a device, which allows an affected vehicle to be transported from a first position to a second position, is required.

Conventionally, vehicles involved in an accident are towed away by other vehicles. This is possible when the vehicle to be towed is accessible. Additionally, in the event of a fire, several vehicles may have to be passed by a fire engine to effectively fight the fire. Due to existing traffic in the tunnel, it is highly improbable for a fire-fighting vehicle to reach the affected area in time. The problem is that all traffic lanes are closed because of the influx of cars and hence supplying relief aid is difficult. The tunnel remains inaccessible to relief. Additionally, opening the path may lead to more accidents. A device, which effectively controls a fire outbreak in a tunnel without being obstructed by existing traffic, is required.

Hence, there is a long felt but unresolved need for a device, which allows instant access to an affected area of a tunnel to prevent obstruction of traffic. Moreover, there is a need for a device, which allows an affected vehicle to be transported from a first position to a second position. Furthermore, there is a need for a device, which effectively controls a fire outbreak in a tunnel without being obstructed by existing traffic.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The tunnel relief device, disclosed herein, addresses the above-mentioned need for a device, which allows instant access to an affected area of a tunnel to prevent obstruction of traffic. Moreover, the invention addresses the need for a device, which allows an affected vehicle to be transported from a first position to a second position. Furthermore, the invention addresses the need for a device, which effectively controls a fire outbreak in a tunnel without being obstructed by existing traffic. The tunnel relief device will be applied for relief operations through tunnels, which are not easily accessible and will be controlled remotely. Additionally, the tunnel relief device is used to carry damaged or stopped cars caused by accident or technical problems that can block the roads, and this will open the way of emergency service to arrive at the destination at the earliest possible time. In addition, the tunnel relief device can extinguish the fire caused by accidents. The tunnel relief device recognizes the type of event using cameras positioned on the tunnel relief device and determines a state of the tunnel. The tunnel relief device can then be remotely operated to One aspect of the present disclosure is directed to a tunnel relief device, disclosed herein, for ensuring safe and unobstructed movement of vehicles in a tunnel comprises a generally arcuate frame member, at least two fire-extinguishing arms, and a transport assembly. The generally arcuate frame member is configured to traverse along a length of the tunnel via first guide rails positioned on an inner surface of the tunnel. The two fire-extinguishing arms are positioned on an inner surface of the generally arcuate frame member.

The two fire-extinguishing arms are configured to traverse along the inner surface of the generally arcuate frame member via second guide rails to extinguish fire induced in the tunnel. The transport assembly comprise extendable arms and is housed in an upper region of the generally arcuate frame member. The extendable arms are movable in one of a horizontal direction and a vertical direction. The transport assembly is rotatably engaged to the upper region of the generally arcuate frame member to transport the vehicles in the tunnel from a first position to a second position to ensure safe and unobstructed movement of the vehicles in the tunnel.

One aspect of the present disclosure is a tunnel relief device for ensuring safe and unobstructed movement of vehicles in a tunnel, the tunnel relief device comprising: (a) a generally arcuate frame member configured to traverse along a length of the tunnel via first guide rails positioned on an inner surface of the tunnel; (b) at least two fire-extinguishing arms positioned on an inner surface of the generally arcuate frame member, wherein the at least two fire-extinguishing arms are configured to traverse along the inner surface of the generally arcuate frame member via second guide rails to extinguish fire induced in the tunnel; and (c) a transport assembly comprising extendable arms, the transport assembly housed in an upper region of the generally arcuate frame member, wherein the extendable arms are movable in one of a horizontal direction and a vertical direction, wherein the transport assembly is rotatably engaged to the upper region of the generally arcuate frame member to transport the vehicles in the tunnel from a first position to a second position to ensure safe and unobstructed movement of the vehicles in the tunnel.

In one embodiment, each of the extendable arms comprise prongs for positioning beneath wheels of the vehicles to transport the vehicles from the first position to the second position. In another embodiment, a visual indicator is positioned on the generally arcuate frame member to alert approaching vehicles of a state of the tunnel. In another embodiment, the transport assembly is remotely operable via a control device. In one embodiment, each of the at least two fire-extinguishing arms comprise a nozzle for targeting the fire induced in the tunnel. In one embodiment, the at least two fire-extinguishing arms are remotely operable via a control device. In one embodiment, the tunnel relief device further comprises a plurality of image processing units for capturing images of the tunnel to determine a state of the tunnel.

One aspect of the present disclosure is directed to a tunnel relief device for ensuring safe and unobstructed movement of vehicles in a tunnel, the tunnel relief device comprising: (a) a generally arcuate frame member comprising roller elements positioned proximal to a lower region of the generally arcuate frame member, wherein the generally arcuate frame member traverses along a length of the tunnel via operable engagement of the roller elements with first guide rails positioned on an inner surface of the tunnel; (b) at least two fire-extinguishing arms positioned on an inner surface of the generally arcuate frame member, wherein the at least two fire-extinguishing arms are configured to traverse along the inner surface of the generally arcuate frame member via second guide rails, and wherein each of the at least two fire-extinguishing arms comprise a nozzle for targeting and extinguishing fire induced in the tunnel; and (c) a transport assembly housed in an upper region of the generally arcuate frame member, the transport assembly comprising: (i) extendable arms movable in one of a horizontal direction and a vertical direction, each of the extendable arms comprising prongs for positioning beneath wheels of the vehicles to transport the vehicles from a first position to a second position; and (ii) wherein the transport assembly is rotatably engaged to the upper region of the generally arcuate frame member to transport the vehicles in the tunnel from the first position to the second position to ensure safe and unobstructed movement of the vehicles in the tunnel.

In one embodiment, a visual indicator is positioned on the generally arcuate frame member to alert approaching vehicles of a state of the tunnel. In another embodiment, the transport assembly is remotely operable via a control device. In one embodiment, each of the at least two fire-extinguishing arms comprise a nozzle for targeting the fire induced in the tunnel. In one embodiment, the at least two fire-extinguishing arms are remotely operable via a control device. In one embodiment, the tunnel relief device further comprises a plurality of image processing units for capturing images of the tunnel to determine a state of the tunnel.

Another aspect of the present disclosure is directed to a method for ensuring safe and unobstructed movement of vehicles in a tunnel, the method comprising: (a) providing a tunnel relief device comprising: a generally arcuate frame member; at least two fire-extinguishing arms; and a transport assembly comprising extendable arms; (b) locating a position of an affected vehicle; (c) positioning the tunnel relief device above the affected vehicle; (d) positioning prongs of the extendable arms beneath wheels of the affected vehicle; (e) lifting the affected vehicle from a first position; and (f) transporting the affected vehicle to a second position for ensuring safe and unobstructed movement of vehicles in a tunnel.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION

A description of embodiments of the present invention will now be given with reference to the Figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The present invention generally relates to tunnel safety devices. More particularly, the invention disclosed herein relates to a tunnel relief device for ensuring safe and unobstructed movement of vehicles in a tunnel.

Figure 1:
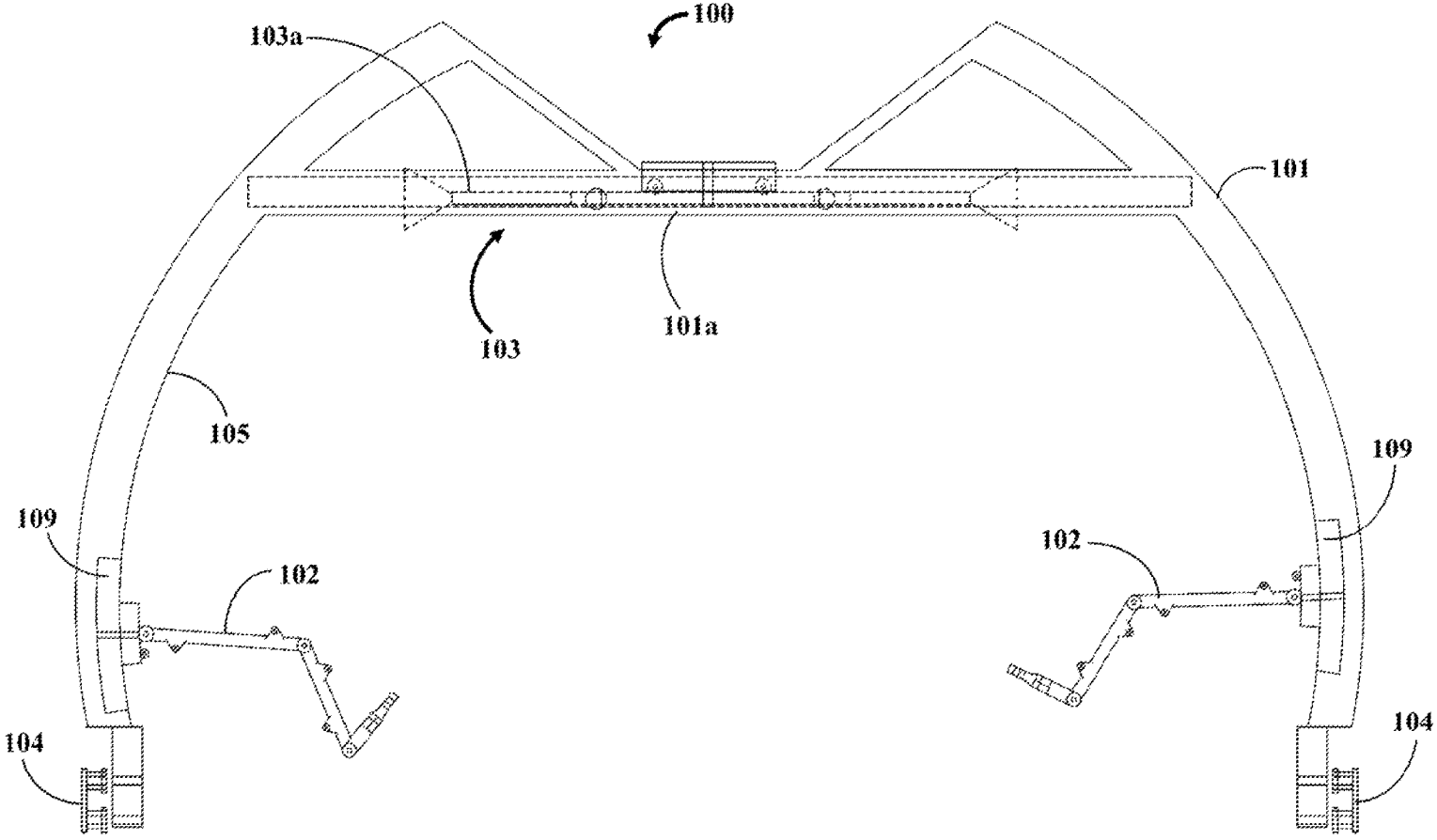
FIG. 1 exemplarily illustrates a front elevation view of a tunnel relief device.

FIG. 1 exemplarily illustrates a front elevation view of a tunnel relief device 100. A tunnel relief device 100 for ensuring safe and unobstructed movement of vehicles in a tunnel comprises a generally arcuate frame member 101, at least two fire-extinguishing arms 102, and a transport assembly 103. The generally arcuate frame member 101 is configured to traverse along a length of the tunnel via first guide rails 104 positioned on an inner surface of the tunnel. The fire-extinguishing arms 102 are positioned on an inner surface of the generally arcuate frame member 101. In an embodiment, the at least two fire-extinguishing arms 102 are configured to traverse along the inner surface of the generally arcuate frame member 101 via second guide rails 105 to extinguish fire induced in the tunnel. The transport assembly 103 comprise extendable arms 103*a*. The transport assembly 103 is housed in an upper region 101*a* of the generally arcuate frame member 101. The extendable arms 103*a* are movable in one of a horizontal direction and a vertical direction. The transport assembly 103 is rotatably engaged to the upper region 101*a* of the generally arcuate frame member 101 to transport the vehicles in the tunnel from a first position to a second position to ensure safe and unobstructed movement of the vehicles in the tunnel.

The tunnel relief device 100 is used for clearing the passageway of the tunnel in case of accident or a traffic block due to a malfunctioning vehicle. In an embodiment, personnel of the traffic control room operate the tunnel relief device 100 remotely via a control device. The tunnel relief device 100 is positioned inside the tunnel and traverses the length of the tunnel via the first guide rails 104. The tunnel relief device 100 is remotely controlled and sent to the scene of the incident by personnel of the traffic control room.

One aspect of the present disclosure is a tunnel relief device for ensuring safe and unobstructed movement of vehicles in a tunnel. The tunnel relief device comprises a generally arcuate frame member configured to traverse along a length of the tunnel via first guide rails positioned on an inner surface of the tunnel; and at least two fire-extinguishing arms positioned on an inner surface of the generally arcuate frame member, wherein the at least two fire-extinguishing arms are configured to traverse along the inner surface of the generally arcuate frame member via second guide rails to extinguish fire induced in the tunnel. The tunnel relief device further comprises a transport assembly comprising extendable arms. The transport assembly may be housed in an upper region of the generally arcuate frame member, and the extendable arms may be movable in one of a horizontal direction and a vertical direction. The transport assembly may be rotatably engaged to the upper region of the generally arcuate frame member to transport the vehicles in the tunnel from a first position to a second position to ensure safe and unobstructed movement of the vehicles in the tunnel.

Figure 2A:
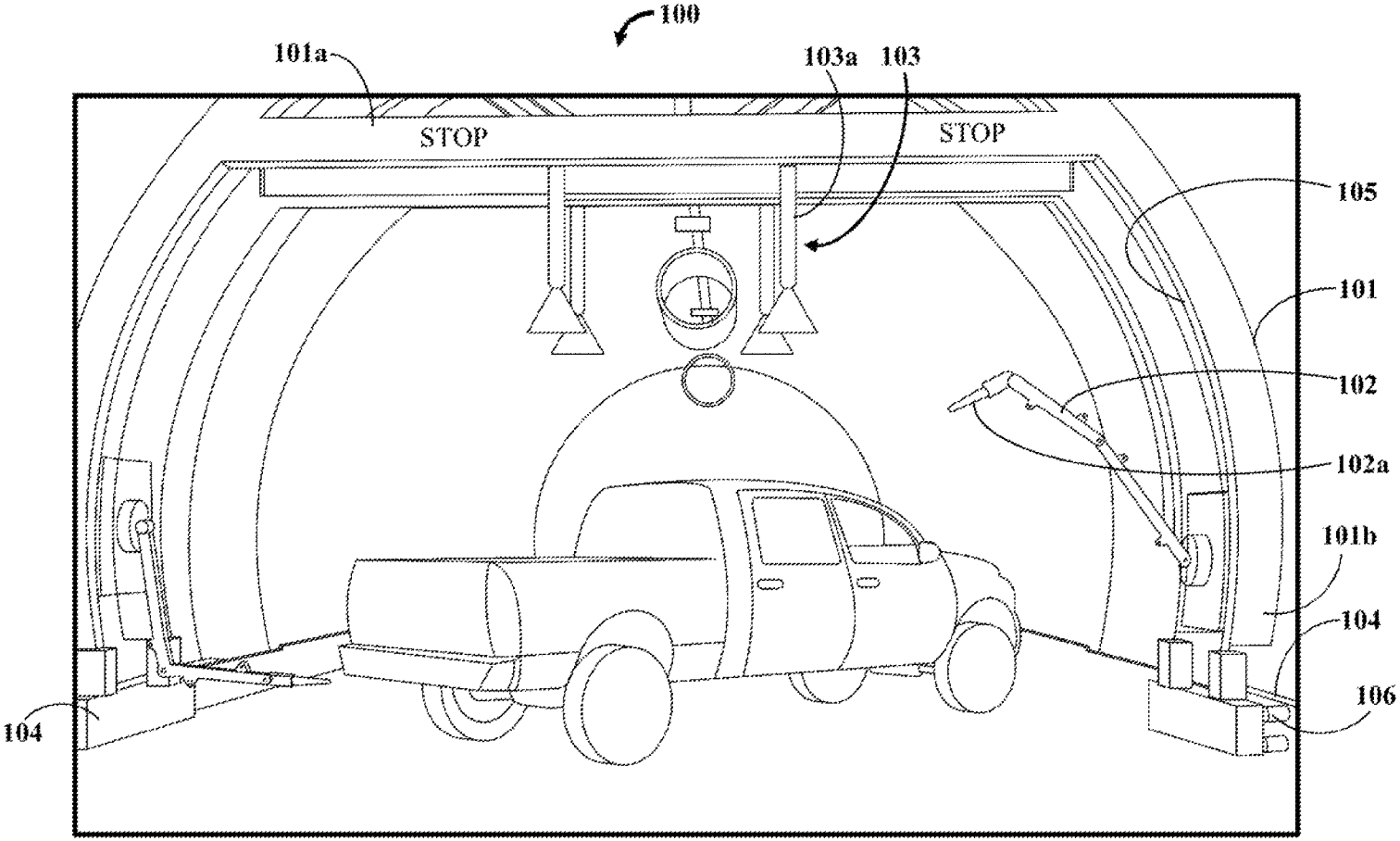
FIG. 2A exemplarily illustrates a perspective view of a tunnel relief device.
Figure 2B:
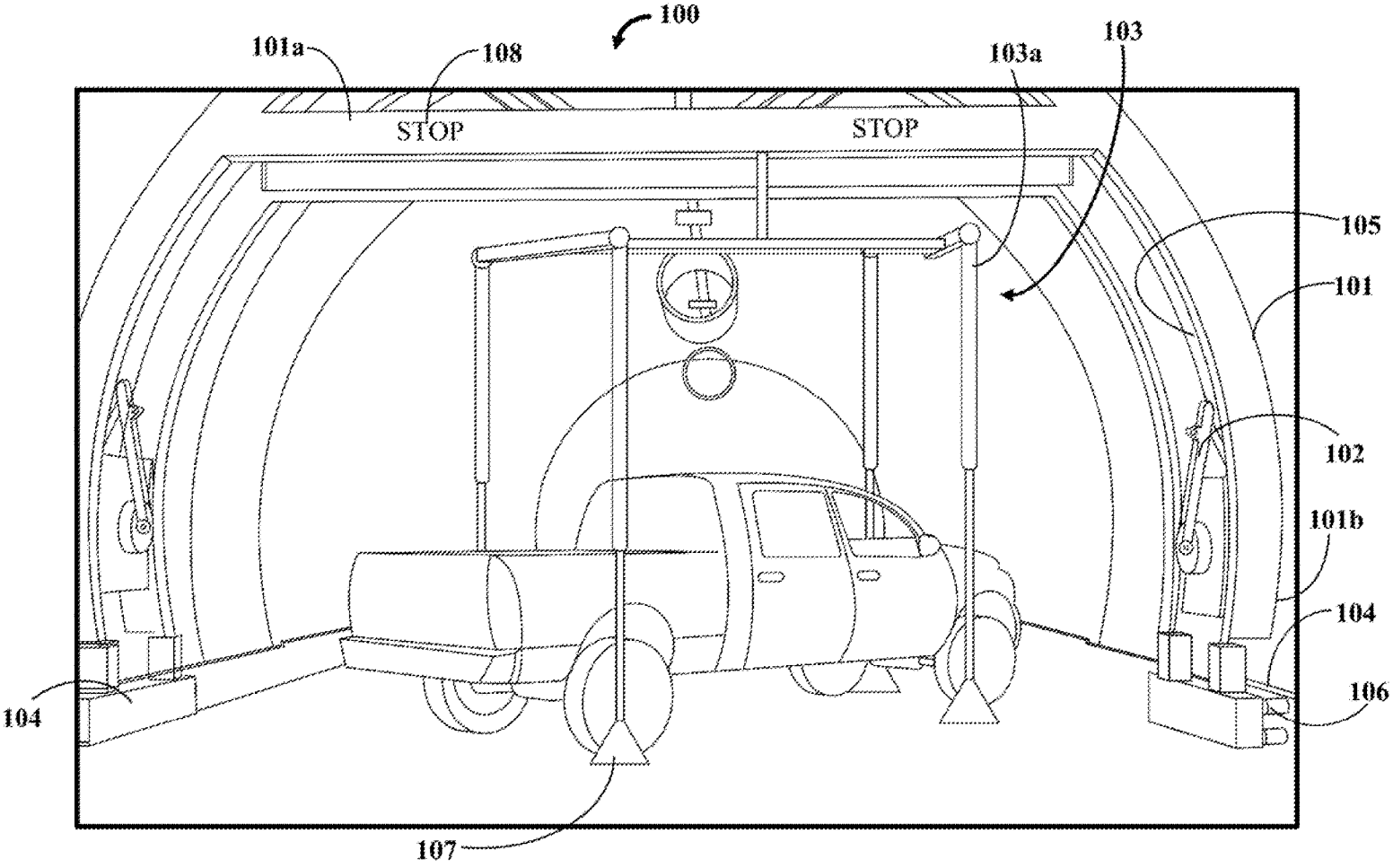
FIG. 2B exemplarily illustrates a perspective view of a tunnel relief device.

FIG. 2A exemplarily illustrates a perspective view of a tunnel relief device 100. In an embodiment, the tunnel relief device 100 approaches the affected vehicle via the first guide rails 104 as exemplarily illustrated in FIG. 2A. FIG. 2B exemplarily illustrates a perspective view of a tunnel relief device 100. The tunnel relief device comprises a generally arcuate frame member 101, at least two fire-extinguishing arms 102, and a transport assembly 103. In an embodiment, the generally arcuate frame member 101 comprises roller elements 106 positioned proximal to a lower region 101*b* of the generally arcuate frame member 101. The generally arcuate frame member 101 traverses along a length of the tunnel via operable engagement of the roller elements 106 with first guide rails 104 positioned on an inner surface of the tunnel. In an embodiment, the fire-extinguishing arms 102 are positioned on an inner surface of the generally arcuate frame member 101. The fire-extinguishing arms 102 are configured to traverse along the inner surface of the generally arcuate frame member 101 via second guide rails 105. Each of the at least two fire-extinguishing arms 102 comprise a nozzle 102*a* for targeting and extinguishing fire induced in the tunnel.

Each of the extendable arms may comprise prongs for positioning beneath wheels of the vehicles to transport the vehicles from the first position to the second position. A visual indicator may be positioned on the generally arcuate frame member to alert approaching vehicles of a state of the tunnel. The transport assembly may be remotely operable via a control device. Each of the at least two fire-extinguishing arms comprise a nozzle for targeting the fire induced in the tunnel. The fire-extinguishing arms may be remotely operable via a control device. The tunnel relief device may further a plurality of image processing units for capturing images of the tunnel to determine a state of the tunnel.

In an embodiment, the transport assembly 103 is housed in an upper region 101*a* of the generally arcuate frame member 101 as exemplarily illustrated in FIG. 1. The transport assembly 103 comprises extendable arms 103*a* movable in a horizontal direction or a vertical direction. Each of the extendable arms 103*a* comprise prongs 107 for positioning beneath wheels of the vehicles to transport the vehicles from a first position to a second position as exemplarily illustrated in FIGS. 2B, 3A-3B. The transport assembly 103 is rotatably engaged to the upper region 101*a* of the generally arcuate frame member 101 to transport the vehicles in the tunnel from the first position to the second position to ensure safe and unobstructed movement of the vehicles in the tunnel. In an embodiment, a visual indicator 108 is positioned on the generally arcuate frame member 101 to alert approaching vehicles of a state of the tunnel. If a relief operation is being carried out or an accident has occurred, the visual indicators 108 of the generally arcuate frame member 101 alert approaching vehicles to stop. The visual indicators 108 are positioned on an upper region 101*a* of the generally arcuate frame member 101.

Figure 3A:
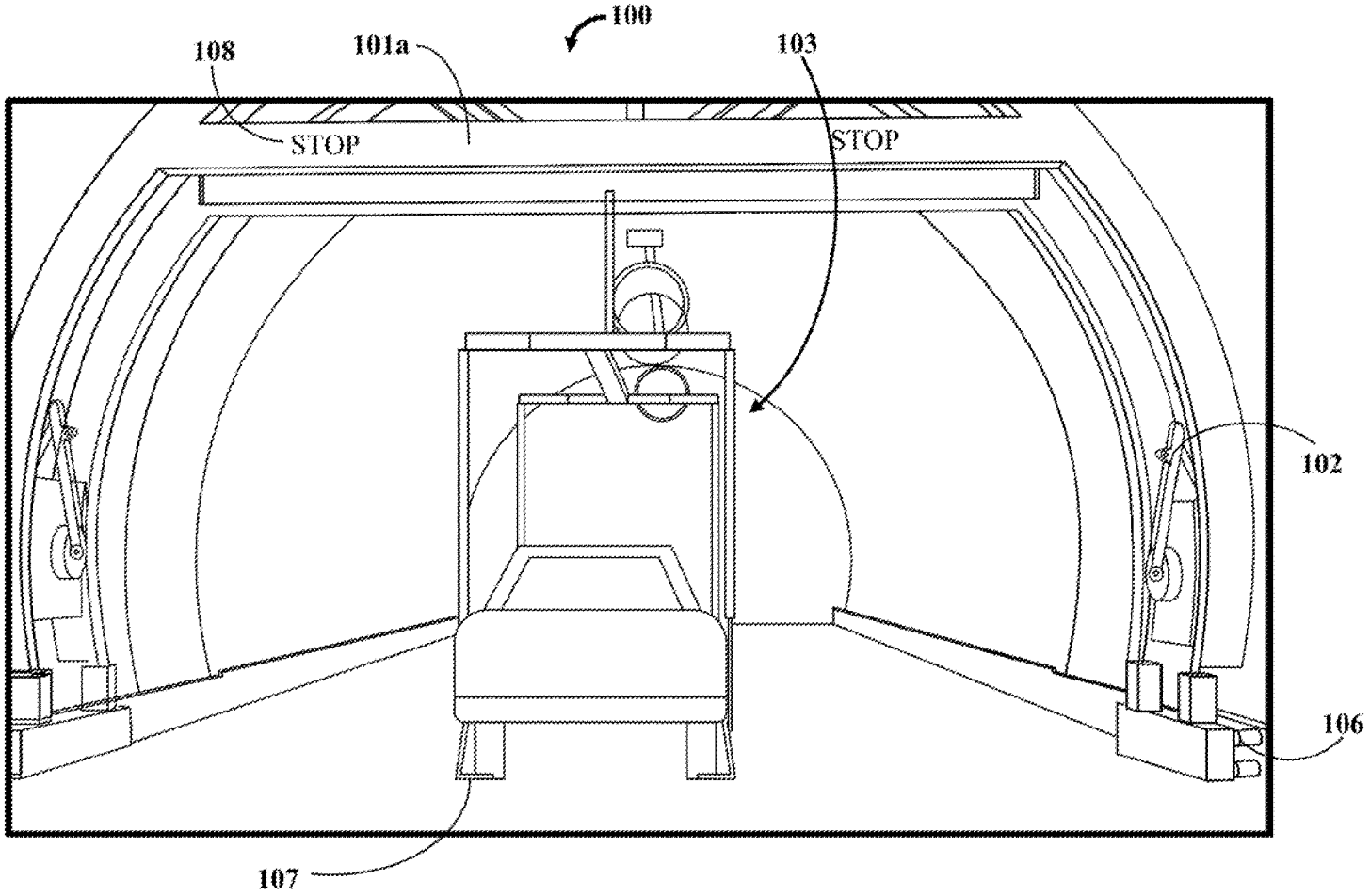
FIG. 3A exemplarily illustrates a perspective view of a tunnel relief device.

FIG. 3A exemplarily illustrates a perspective view of a tunnel relief device 100 showing the transport assembly 103 positioned to transport the affected vehicle from the first position. In an embodiment, the transport assembly 103 is remotely operable via a control device. Moreover, the fire-extinguishing arms 102 are remotely operable via a control device. In an embodiment, the tunnel relief device 100 further comprises a plurality of image processing units 109 for capturing images of the tunnel to determine a state of the tunnel. In the event of an accident, the cameras process images of the tunnel and relay the images to the control device. Based on the received images personnel of the traffic control room proceed to transport the affected vehicle via the transport assembly 103. Additionally, the visual indicator 108 alerts approaching vehicles to stop. Once the prongs 107 are positioned beneath the wheels of the vehicle, the vehicle is lifted from the position to a second position as exemplarily illustrated in FIG. 3B. The extendable arms 103*a*, exemplarily illustrated in FIGS. 2A-2B, are oriented at right angles to the affected vehicle. Moreover, the transport assembly 103 are also capable of 360-degree rotation. In an embodiment, the extendable arms 103*a* of the transport assembly 103 are actuated via actuators, for example, hydraulic actuators, pneumatic actuators, electrical actuators, etc.

Figure 3B:
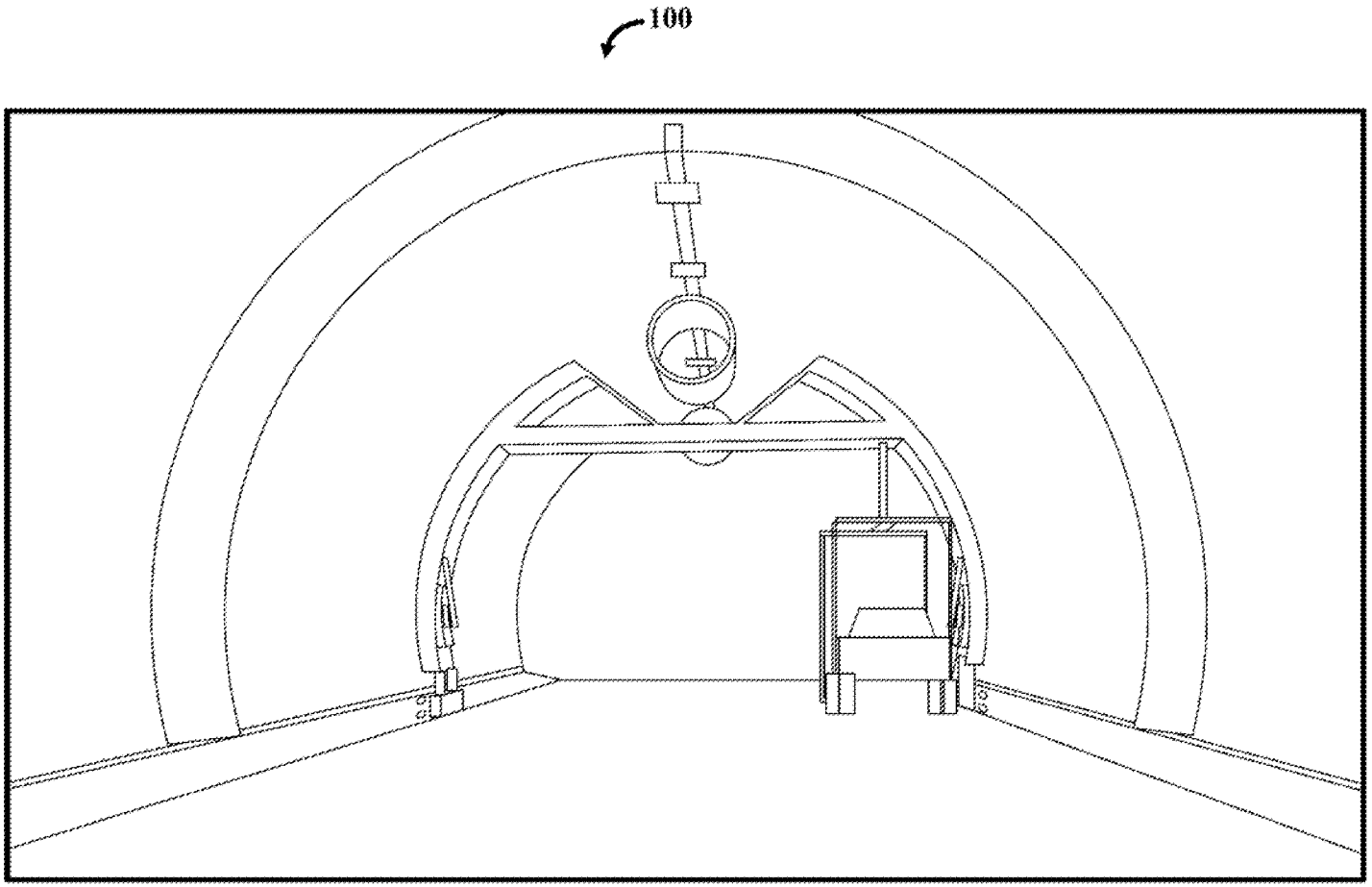
FIG. 3B exemplarily illustrates a perspective view of a tunnel relief device.

FIG. 3B exemplarily illustrates a perspective view of a tunnel relief device 100 showing the affected vehicle transported to the second position via the transport assembly 103 exemplarily illustrated in FIG. 3A. This ensures the passageway remains unobstructed for the remaining vehicles approaching the tunnel. Moreover, other relief vehicles for example, tow trucks, ambulances, etc., are thus provided space to access the affected vehicle. In the event of a tunnel blockade due to a malfunctioning vehicle or a vehicle that has undergone an accident, the tunnel relief device 100 allows clear and open passageway for approaching traffic. In the event of a fire, the fire-extinguishing arms 102, exemplarily illustrated in FIGS. 1-3A, extend from the tunnel relief device 100 and spray fire-extinguishing agents, for example, foams, dry chemicals, etc. Image processing units, for example, cameras, thermal imaging devices, etc., enable personnel from the traffic control room to effectively control the fire outbreak in the tunnel.

Another aspect of the present disclosure is directed to a tunnel relief device for ensuring safe and unobstructed movement of vehicles in a tunnel. The tunnel relief device comprises a generally arcuate frame member comprising roller elements positioned proximal to a lower region of the generally arcuate frame member, wherein the generally arcuate frame member traverses along a length of the tunnel via operable engagement of the roller elements with first guide rails positioned on an inner surface of the tunnel.

The tunnel relief device may further comprise at least two fire-extinguishing arms positioned on an inner surface of the generally arcuate frame member. These at least two fire-extinguishing arms may be configured to traverse along the inner surface of the generally arcuate frame member via second guide rails, and each of the at least two fire-extinguishing arms may comprise a nozzle for targeting and extinguishing fire induced in the tunnel.

The tunnel relief device may further comprise a transport assembly housed in an upper region of the generally arcuate frame member. The transport assembly may comprise extendable arms movable in one of a horizontal direction and a vertical direction, each of the extendable arms comprising prongs for positioning beneath wheels of the vehicles to transport the vehicles from a first position to a second position. The transport assembly may be rotatably engaged to the upper region of the generally arcuate frame member to transport the vehicles in the tunnel from the first position to the second position to ensure safe and unobstructed movement of the vehicles in the tunnel. A visual indicator may be positioned on the generally arcuate frame member to alert approaching vehicles of a state of the tunnel.

Figure 4:
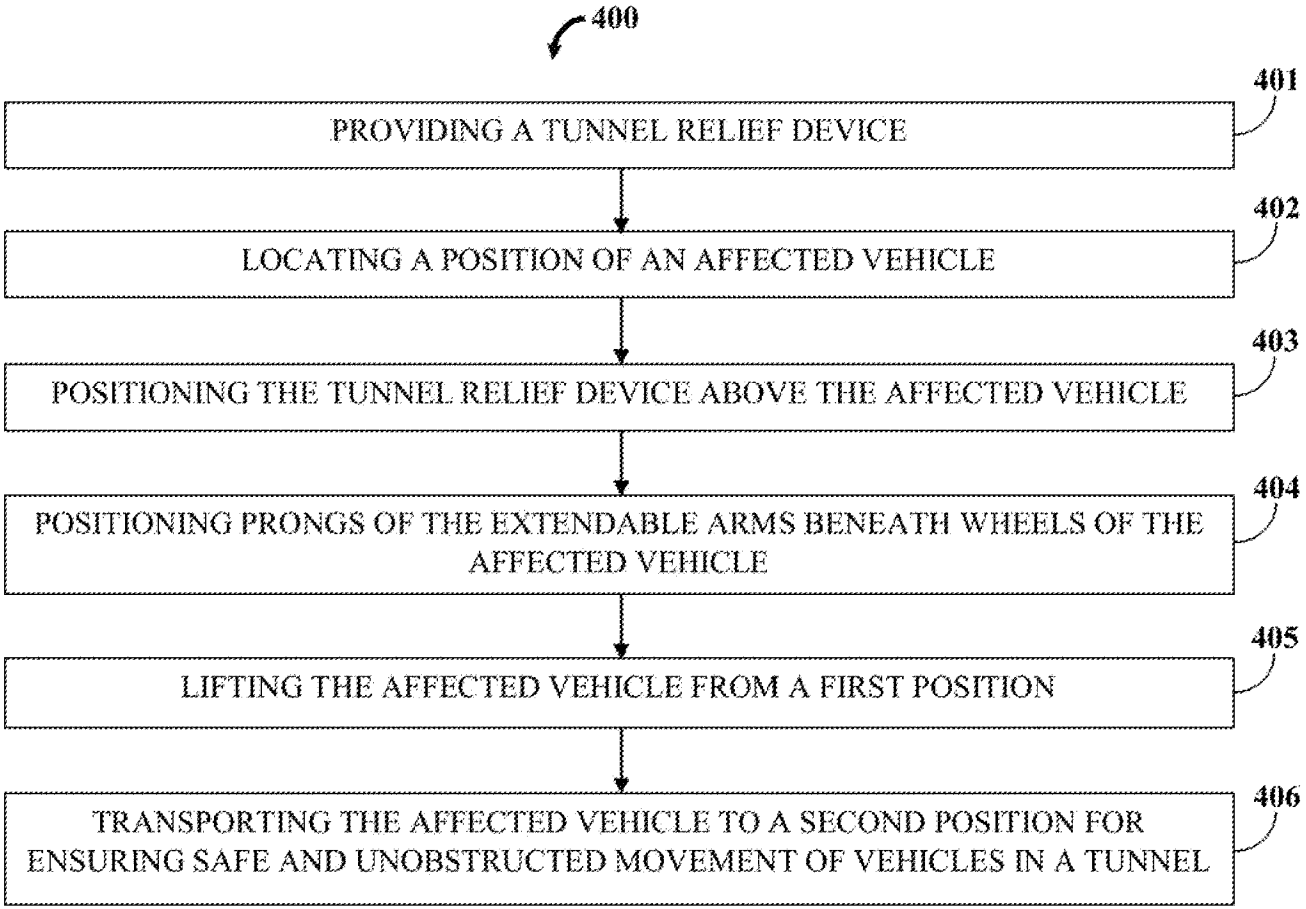
FIG. 4 exemplarily illustrates a method for ensuring safe and unobstructed movement of vehicles in a tunnel.

FIG. 4 exemplarily illustrates a method 400 for ensuring safe and unobstructed movement of vehicles in a tunnel. In Step 401, a tunnel relief device 100, is provided. In Step 402, the tunnel relief device 100 locates a position of an affected vehicle. In Step 403, the tunnel relief device 100 is positioned above the affected vehicle. In Step 404, the prongs 107 of the extendable arms 103*a* are positioned beneath the wheels of the affected vehicle as exemplarily illustrated in FIG. 2B. In Step 405, the affected vehicle is lifted from a first position. In Step 406, the affected vehicle is transported to a second position for ensuring safe and unobstructed movement of vehicles in the tunnel as exemplarily illustrated in FIG. 3B.

Another aspect of the present disclosure is directed to a method for ensuring safe and unobstructed movement of vehicles in a tunnel. The method comprises providing a tunnel relief device. The tunnel relief device comprises a generally arcuate frame member; at least two fire-extinguishing arms; and a transport assembly comprising extendable arms. The method further comprises locating a position of an affected vehicle; and positioning the tunnel relief device above the affected vehicle. Once the tunnel relief device is positioned above the affected vehicle, the method involves positioning prongs of the extendable arms beneath wheels of the affected vehicle; lifting the affected vehicle from a first position; and transporting the affected vehicle to a second position for ensuring safe and unobstructed movement of vehicles in a tunnel.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method.

Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein.

What is claimed is:

1. A tunnel relief device for ensuring safe and unobstructed movement of vehicles in a tunnel, the tunnel relief device comprising:

a generally arcuate frame member configured to traverse along a length of the tunnel via first guide rails positioned on an inner surface of the tunnel;

at least two fire-extinguishing arms positioned on an inner surface of the generally arcuate frame member, wherein the at least two fire-extinguishing arms are configured to traverse along the inner surface of the generally arcuate frame member via second guide rails to extinguish fire induced in the tunnel; and a transport assembly comprising extendable arms, the transport assembly housed in an upper region of the generally arcuate frame member, wherein the extendable arms are movable in one of a horizontal direction and a vertical direction, wherein the transport assembly is rotatably engaged to the upper region of the generally arcuate frame member to transport the vehicles in the tunnel from a first position to a second position to ensure safe and unobstructed movement of the vehicles in the tunnel.

2. The tunnel relief device of claim 1, wherein each of the extendable arms comprises prongs for positioning beneath wheels of the vehicles to transport the vehicles from the first position to the second position.

3. The tunnel relief device of claim 1, wherein a visual indicator is positioned on the generally arcuate frame member to alert approaching vehicles of a state of the tunnel.

4. The tunnel relief device of claim 1, wherein the transport assembly is remotely operable via a control device.

5. The tunnel relief device of claim 1, wherein each of the at least two fire-extinguishing arms comprises a nozzle for targeting the fire induced in the tunnel.

6. The tunnel relief device of claim 1, wherein the at least two fire-extinguishing arms are remotely operable via a control device.

7. The tunnel relief device of claim 1, further comprising a plurality of image processing units for capturing images of the tunnel to determine a state of the tunnel.

8. A tunnel relief device for ensuring safe and unobstructed movement of vehicles in a tunnel, the tunnel relief device comprising:

a generally arcuate frame member comprising roller elements positioned proximal to a lower region of the generally arcuate frame member, wherein the generally arcuate frame member traverses along a length of the tunnel via operable engagement of the roller elements with first guide rails positioned on an inner surface of the tunnel;

at least two fire-extinguishing arms positioned on an inner surface of the generally arcuate frame member, wherein the at least two fire-extinguishing arms are configured to traverse along the inner surface of the generally arcuate frame member via second guide rails, and wherein each of the at least two fire-extinguishing arms comprises a nozzle for targeting and extinguishing fire induced in the tunnel; and a transport assembly housed in an upper region of the generally arcuate frame member, the transport assembly comprising:

extendable arms movable in one of a horizontal direction and a vertical direction, each of the extendable arms comprising prongs for positioning beneath wheels of the vehicles to transport the vehicles from a first position to a second position; and wherein the transport assembly is rotatably engaged to the upper region of the generally arcuate frame member to transport the vehicles in the tunnel from the first position to the second position to ensure safe and unobstructed movement of the vehicles in the tunnel.

9. The tunnel relief device of claim 8, wherein a visual indicator is positioned on the generally arcuate frame member to alert approaching vehicles of a state of the tunnel.

10. The tunnel relief device of claim 8, wherein the transport assembly is remotely operable via a control device.

11. The tunnel relief device of claim 8, wherein the at least two fire-extinguishing arms are remotely operable via a control device.

12. The tunnel relief device of claim 8, further comprising a plurality of image processing units for capturing images of the tunnel to determine a state of the tunnel.

13. A method for ensuring safe and unobstructed movement of vehicles in a tunnel, the method comprising:

providing a tunnel relief device comprising:

a generally arcuate frame member;

at least two fire-extinguishing arms; and a transport assembly comprising extendable arms;

locating a position of an affected vehicle;

positioning the tunnel relief device above the affected vehicle;

positioning prongs of the extendable arms beneath wheels of the affected vehicle;

lifting the affected vehicle from a first position; and transporting the affected vehicle to a second position for ensuring safe and unobstructed movement of vehicles in a tunnel.

14. The method of claim 13, wherein a visual indicator is positioned on the generally arcuate frame member to alert approaching vehicles of a state of the tunnel.

15. The method of claim 13, wherein the transport assembly is remotely operable via a control device.

16. The method of claim 13, wherein each of the at least two fire-extinguishing arms comprises a nozzle for targeting fire induced in the tunnel.

17. The method of claim 13, wherein the at least two fire-extinguishing arms are remotely operable via a control device.

18. The method of claim 13, wherein the generally arcuate frame member further comprises a plurality of image processing units for capturing images of the tunnel to determine a state of the tunnel.

* * * * *